United States Patent [19]

Smith

[11] Patent Number: 4,915,011

[45] Date of Patent: Apr. 10, 1990

[54] BREECH LOCKING SYSTEM FOR SELF LOADING FIREARMS

[75] Inventor: David E. Smith, Wootton, England

[73] Assignee: Victory Arms Co., Ltd., London, England

[21] Appl. No.: 241,501

[22] Filed: Sep. 7, 1988

[30] Foreign Application Priority Data

Sep. 11, 1987 [GB] United Kingdom ..... 8721385
Oct. 26, 1987 [GB] United Kingdom ..... 8724995

[51] Int. Cl.[4] ..... F41C 5/06
[52] U.S. Cl. ..... 89/176; 89/196
[58] Field of Search ..... 89/196, 176, 163, 168, 89/190

[56] References Cited

U.S. PATENT DOCUMENTS

| | | | |
|---|---|---|---|
| 1,176,254 | 3/1916 | Smith | 89/196 |
| 1,333,572 | 3/1920 | Pedersen | 89/196 |
| 2,664,786 | 1/1954 | Guisasola | 89/196 |
| 3,682,040 | 8/1972 | Roy | 89/196 |
| 3,745,881 | 7/1973 | Roy | 89/196 |

FOREIGN PATENT DOCUMENTS

| | | | |
|---|---|---|---|
| 3109730 | of 0000 | Fed. Rep. of Germany | 89/190 |
| 3248453 | of 0000 | Fed. Rep. of Germany | 89/190 |

OTHER PUBLICATIONS

Illustrated Firearms Assembly Handbook, NRA, 1960, pp. 68–69, "Beretta".

*Primary Examiner*—Deborah L. Kyle
*Assistant Examiner*—Michael J. Carone
*Attorney, Agent, or Firm*—Harness, Dickey & Pierce

[57] ABSTRACT

A self loading firearm of the locked breech, short recoil pistol type has a barrel and a breech block slide provided with a separate locking block accommodated between the underside of the barrel and the upper surface of a movable trigger guard. The locking block is provided with means for positively locking the barrel to the slide during the high pressure period of the firing cycle of the firearm and means for enabling release of the slide from the barrel during the remainder of the firing cycle. Means described for permitting release of the locking block comprise a rotary catch which is rotatable between a position to hold the locking block in its barrel retaining position and a position in which the locking block is able to release the barrel. The rotary catch is movable axially between a position in which it is rotatable and a position in which it is non-rotatable, the locking block normally being held in its non-rotatable position by the hold open means and being released from that position when the hold open means is in its operative position to hold the slide fully retracted from its forward firing position.

8 Claims, 5 Drawing Sheets

AA
A1

A9
A11
A
A3
G1
A
K
K1
E16
E3
E10
E
E15
A12

A1
A9

A11
P1
G1
A3
E
T1
T2
A12

C1
C3
C

F7
F
C4
K
X
A3
G1
T
S
E3
F1
E
C6
P
A12
E10

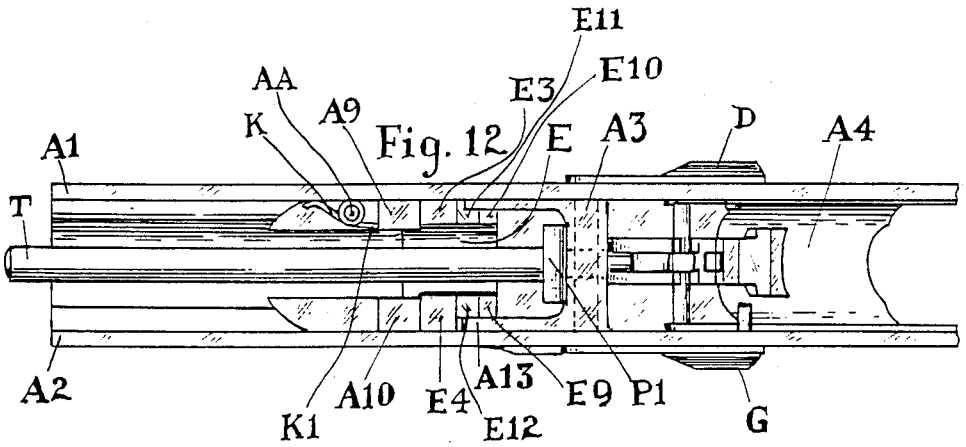
Fig. 12
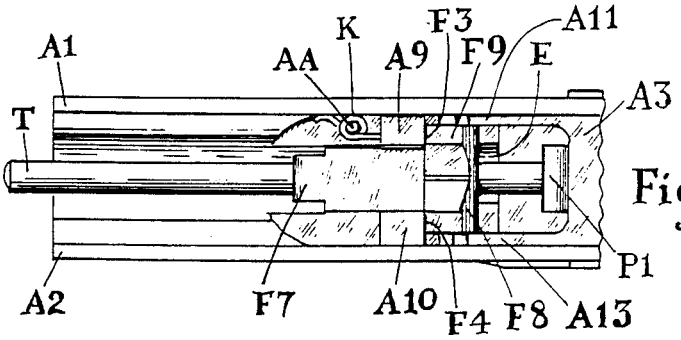
Fig. 13
Fig. 14
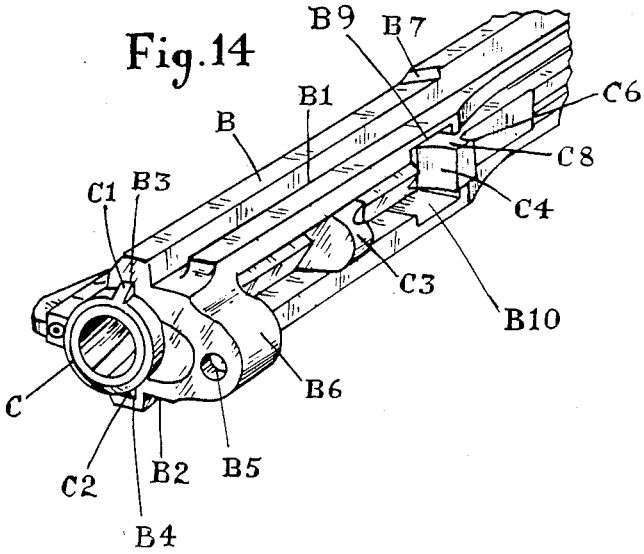

BREECH LOCKING SYSTEM FOR SELF LOADING FIREARMS

This invention relates to firearms of the self loading, locked breech, short recoil, pistol type, in which a separate locking block is employed, and more particularly to firearms of the kind having means for automatically locking the barrel and breech block together during the discharge of the cartridge in the breech, for the purpose of ensuring positive obduration of the cartridge case walls to the breech chamber until the high pressure period of the powder gases during combustion is over, and then automatically to allow the breech block slide to separate from the barrel, to permit the extraction of the cartridge case safely without case wall rupture.

The usual practice in self loading firearms using a locked breech is for them to employ a barrel locking to the breech block slide, by peripheral ribs, studs, or other means, and rotated, cammed, or otherwise engaged and disengaged from the slide before the discharge of the cartridge and after the high pressure period of the cartridge powder gases, respectively, or to employ a separate block to lock the barrel to the slide during the aforesaid high pressure period. The usual practice also in self loading firearms of the locked breech type is to utilise the residual pressure in the barrel interior, plus the inertia of the slide and barrel moving rearwards in reaction to the discharging projectile, to disengage whatever lock is employed, and to furnish the energy required to complete the cycle of cartridge case extraction and ejection, and the reloading of the barrel chamber with a loaded cartridge from a magazine in the firearm.

It is usual for self loading locked breech pistols employing any type of breech locking system to provide means for the removal of the barrel from the pistol. The usual practice is for a catch to be provided which, by manipulation or removal, allows the barrel and slide, together with, in most types of pistol, the recoil spring assembly, to be removed from the pistol main frame. Usually, the barrel can then be removed from within a recess in the slide. The disadvantage of this practice in pistols is that in order to remove the barrel for any reason, additional parts of the pistol must be removed from the main frame, and it is inconvenient to find accommodation for such parts which are liable to be exposed to dirt, be misplaced or damaged. In the Walther P38 and P5, and the Beretta 951 and 92 types, the locking block is accommodated in a recess under the rear of the barrel. Although the Walther locking block is easily detached from the barrel, it is possible to reassemble the pistol with the block absent, resulting in a very dangerous situation should the pistol then be fired with a normal ball cartridge. The Beretta pistols require tools to detach the locking block. In both types of pistol the locking block is attached, and is removed with the barrel. Greater convenience is provided by certain pistols with low pressure cartridges and not requiring a locked breech, that allow the barrel alone to be removed initially, with the rest of the pistol being left intact.

A previous design using a separate locking block allowed easy removal and assembly from and to the pistol of the barrel alone, but the design did not allow the incorporation of a single helical coil compression spring acting as a recoil spring, in the space normally occupied by a recoil spring, under the barrel, as in other types of locked breech pistols. Space had to be provided elsewhere in the pistol for a recoil spring or recoil springs to be fitted.

It is, therefore, an object of the present invention to provide for self loading pistols using high pressure cartridges, a system that provides a positive lock between barrel and breech block slide during the high pressure period of the firing cycle, and that allows the normal operation of such pistol or firearm, while also providing that the barrel alone can be removed from the firearm when required.

It is another object of the invention to provide a locking block for a self loading firearm or pistol that is easily removed but is an essential part of the pistol or firearm, and cannot be left out on assembly.

Finally, it is an object to provide a breech locking system for a self loading pistol or other firearm which is of simple construction and cheap to manufacture while also serving to simplfy the manipulations involved in disassembling and assembling a self loading pistol or other firearm.

According to one aspect of the invention, there is provided a self loading firearm of the locked breech, short recoil pistol type having a frame, a barrel having an underside, a breech block slide and hold open means operative to hold the slide in a fully retracted position relative to the frame, said firearm being provided with a separate locking block accommodated in part beneath the underside of the said barrel and itself being provided with means for positively locking the barrel to the slide during the high pressure period of the firing cycle of the firearm and means for enabling release of the slide from the barrel during the remainder of the firing cycle, means being provided for permitting release of the locking block only when the breech block slide is held to the fully retracted position by said hold open means to disengage the barrel to permit the barrel to be removed from the firearm without need for further disassembly of the firearm.

A preferred aspect of the invention provides a self loading firearm of the locked breech, short recoil pistol type having a frame, a barrel having an underside and a breech block slide movable relative to said frame between a forward battery position and a rearward fully retracted position, said firearm also comprising a separate locking block located at least in part beneath the underside of said barrel and a rotary catch having an upper surface, said rotary catch being axially movable between a retracted and a projecting position and being, when in said projecting position, rotatable between a position in which said upper surface holds the locking block in its barrel retaining position and a position in which said upper surface permits the locking block to be lowered to release the barrel.

Preferably, the firearm includes slide hold open means operative to hold the slide in said fully retracted position relative to the frame, said slide open means holding the rotary catch against axial movement from said retracted position except when the slide hold open means is fully operative, it being necessary axially to move the rotary catch between said retracted position in which it is non rotatable to said projecting position in which it is rotatable to permit the locking block to release the barrel.

This embodiment preferably includes a helical coil compression recoil spring mounted below and axially parallel with the barrel and partially encompassed by said rotary catch and said locking block.

As later described by way of example, the preferred firearm includes cam means on the frame operative to cam the locking block downwardly from engagement with the slide during initial rearward movement of the slide from said forward battery position.

The frame may conveniently comprise a cam surface engageable with the locking block to cam it upwardly to engage the slide during final movement of the slide to the forward battery position.

Suitably, the barrel may have a recessed lug provided thereon and said locking block comprises a forward radiused nose received in the recess in the lug on the barrel, the locking block having at its rear end two downwardly extending lugs for engagement with the upper surface of the rotary catch, said lugs extending downwardly on opposite sides of the recoil spring.

The breech locking system for a self loading pistol or other firearm as later described does not require tools to assemble and disassemble.

The invention will be further described by way of example, with reference to the accompanying drawings, in which:

FIG. 1 represents in elevation a self loading semi automatic pistol provided with means constructed and arranged in accordance with this invention for locking and unlocking the slide and barrel together during the firing cycles of the pistol, and means to allow the pistol to be assembled and disassembled, the pistol being shown in battery position, with the slide holdopen catch fully depressed and engaged with the rotary lock catch arm;

FIG. 12 is a part plan view of the pistol frame, with the rotary lock catch and the recoil spring guide fitted;

FIG. 13 is a part plan view of the pistol frame, with the rotary lock catch, locking block and recoil spring guide fitted; and FIG. 14 is a partial perspective view of the pistol slide with the barrel fitted, showing the locking recess, viewed from the lower front.

Figures 1, 2:
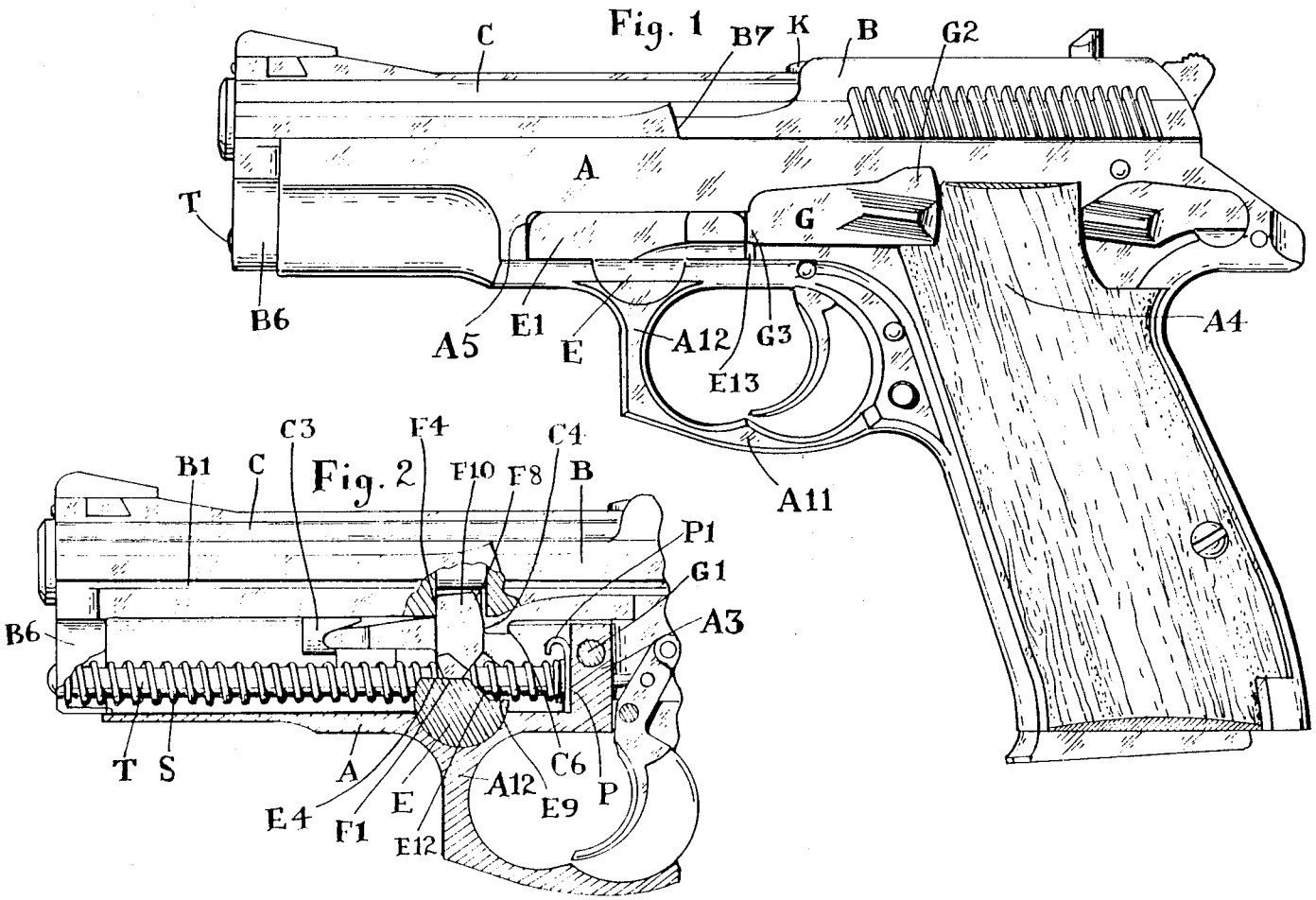
FIG. 2 is a part elevation, part longitudinal vertical section of the forward part of the pistol, with the slide forward in the battery position with the locking block in the forward, up position, locking slide and barrel together.
Figure 3:
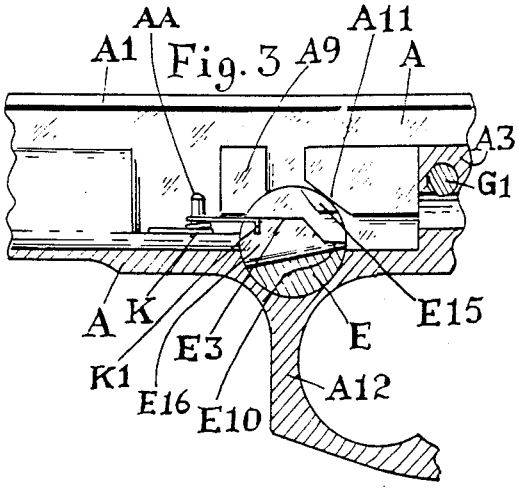
FIG. 3 is a part longitudinal vertical section of the frame around the rotary lock catch location area, with the rotary catch fitted in the frame.
Figure 4:
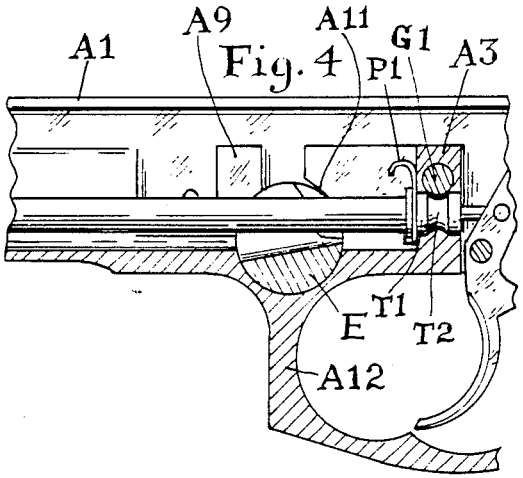
FIG. 4 is a part longitudinal vertical section of the frame around the rotary lock catch area, with the rotary catch and recoil spring guide fitted.

In the self loading pistol represented in FIG. 1, the barrel C and slide B are mounted on the frame A by means of frame rails A1 and A2 engaging slide grooves B1 and B2 shown in FIG. 14. The barrel is mounted in the slide by barrel rails C1 and C2 engaging in slide grooves B3 and B4. The frame has a transverse vertical bridge A3 forward of the upper part of the frame grip section A4 and passing transversely through the frame bridge is an arbor G1 of left slide holdopen catch G. The arbor G1 is engaged within the frame bridge with the arbor of right hold open catch D by means of a bifurcation on one arbor engaging a mating key on the other arbor (not shown). The two hold open catches thereby are able to operate in unison either manually or when acted upon by a rising magazine cartridge follower (not shown). When operated either way, the nose G2 of the left hold open catch will rise and abut with the shoulder B7 on the left side of the slide.

Figure 7:
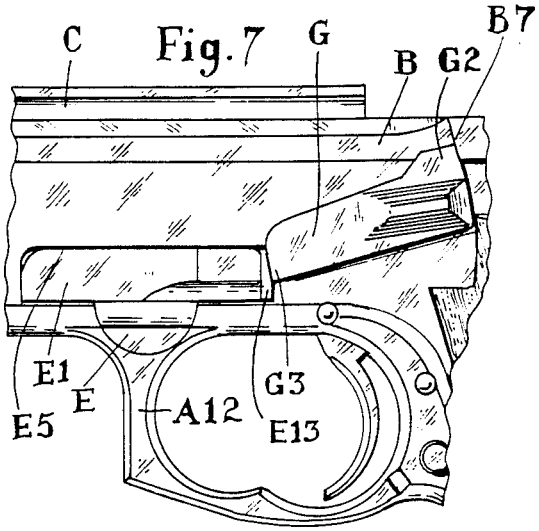
FIG. 7 is a part elevational view of the pistol, around the rotary lock catch and slide hold open catch area, the slide being held to the rear by the raised hold open catch, and the rotary catch clear to move axially to the left.

Forward of the left hold open catch a rotary lock catch E is inserted transversely into the left side of the frame above the forward vertical member A12 of trigger guard A11. One end of the rotary lock catch E is provided with an arm E1 which is receivable within a recess A5 on the left side of the frame, as shown in FIG. 1, FIG. 7 and FIG. 12. A bore A6 is provided within this recess to receive a pin E2 on the catch arm E1, this pin providing a bearing surface upon the surface of recess A5 when the catch E is moved axially and rotated, to prevent the catch arm E1 from rubbing on and causing unsightly wear on the frame side during rotation. The rotary lock catch arm is prevented from rotating when held into the frame recess A5 by the catch arm upper surface E5 abutting frame recess upper ledge A8. Alternatively, the pin E2 on the rotary catch arm may be made a tight fit in the frame bore A6, this tight fit providing a means to prevent rotation of the catch E until it has been moved axially away from the frame.

Carried within the frame of the pistol is a locking block F which has at its lower rear two lugs F1 and F2 which rest upon two surfaces E3 and E4 of the catch E when the slide and barrel are in the forward battery position, and in this position the two flat faces F3 and F4 of the locking block impinge upon frame lugs A9 and A10, thereby preventing the slide and barrel locked together by the locking block from being able to move forward off the frame, and thus being held in the battery position. The front radius F7 of the locking block is engaged in barrel lug C3 and the locking block rear section F8 is held raised into engagement with a vertically concave surface C4 at the front of barrel lug C8, the locking block rear surface F8 being convex to mate with and be a sliding fit with surface C4. The wings F9 and F10 of the locking block locate within vertical cuts B9 and B10 in the slide B when the slide and barrel are in the battery position. Recoil spring S is mounted upon a spring guide T which has its rear end T1 inserted in the frame bridge A3, a peripheral groove T2 on end T1 being engaged by the hold open catch arbor G1 thereby to be held in position and to prevent the guide from becoming free when the slide is removed from the frame. The recoil spring guide passes through slide bridge hole B5 and the forward pressure of the recoil spring on the side bridge B6 urges the locked slide, barrel, and locking block forward, to the battery position.

Figure 5:
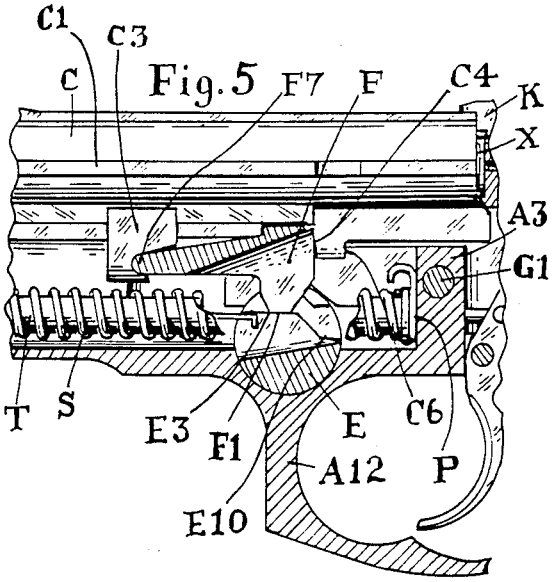
FIG. 5 is a part longitudinal vertical section of the pistol around the rotary lock catch area, showing the pistol as in FIG. 1, and the locking block in longitudinal vertical section locking barrel and slide together.
Figure 6:
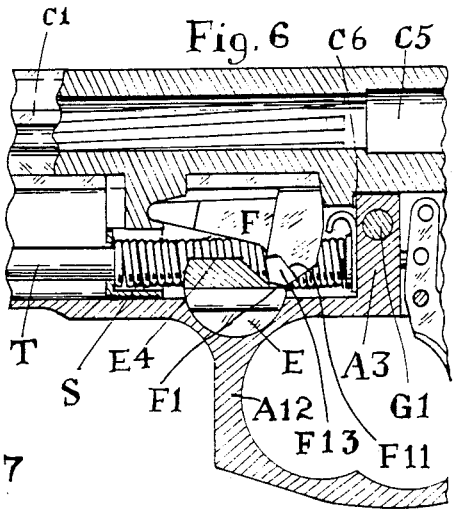
FIG. 6 is a part longitudinal vertical section of the pistol around the rotary lock catch area, showing the pistol in the fully recoiled position, with the barrel fully rearward, the locking block cammed down, and the recoil spring fully compressed.

Upon the slide being retracted either manually or upon the pistol being fired the barrel is carried with the slide by means of the locking block. After a period of travel of approximately 4 mm during which, if the pistol is firing, the powder gas pressure will have dropped, the cam surfaces F11 and F12 of the locking block lugs F13 and F14 impinge upon the frame interior cam surfaces A11 and A13 and the locking lug rear section is cammed down, the locking block rotating around radius section F7 engaged with barrel lug C3. The locking block wings F9 and F10 are withdrawn downwards from their location in slide cuts B9 and B10 thereby releasing the slide to move rearwards under inertia and the residual pressure in the barrel acting upon the cartridge case and thence on the breech face. The barrel will halt its rearwards motion when the barrel lug C6 abuts the front of the frame bridge, and the extractor K will extract the cartridge case X from the barrel chamber C5, and the slide will continue its normal cycle to eject the cartridge case. The locking block is prevented from further downward motion at its rear by the contact of the two locking block lugs F1 and F2 with the rotary lock catch steps E9 and E10. When the slide contacts the rear of the barrel on its forward motion after chambering of a fresh cartridge, the barrel is forced forward and the lug face C4 forces the locking block forward, the locking block lower lugs F1 and F2 being forced to ride up cam slopes E11 and E12 thus raising the rear of the locking block into the slide and barrel locked position as shown in FIGS. 2 and 5.

Figure 8:
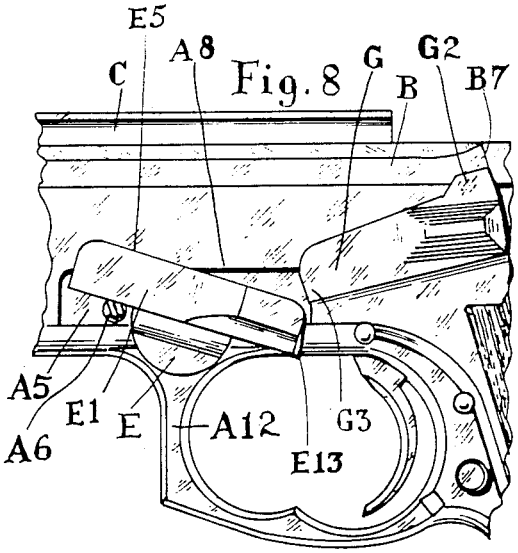
FIG. 8 is a part elevational view of the pistol, around the rotary lock catch and slide hold open catch area, the slide being held to the rear by the raised hold open catch, and the rotary catch moved axially to the left and rotated clockwise in order to lower the rear of the locking block away from the rear of the barrel.
Figure 9:
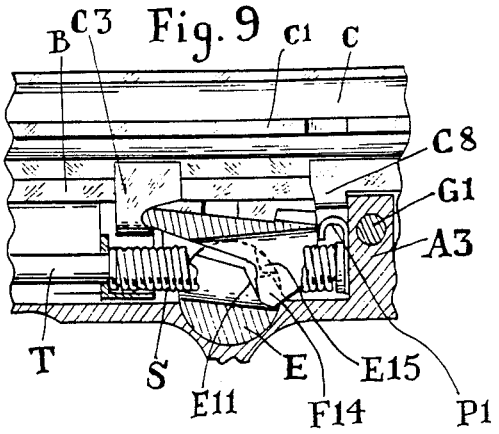
FIG. 9 is a part longitudinal vertical section of the pistol around the rotary lock catch area with the slide held rearwards, the recoil spring compressed, and the rear of the locking block shown in longitudinal vertical section forced down out of engagement with the rear of the barrel by the rotary lock catch.
Figure 10:
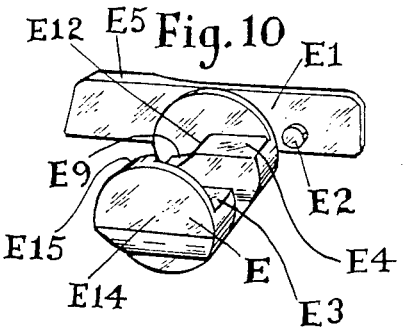
FIG. 10 is a perspective view of the rotary lock catch, viewed from front right upper.
Figure 11:
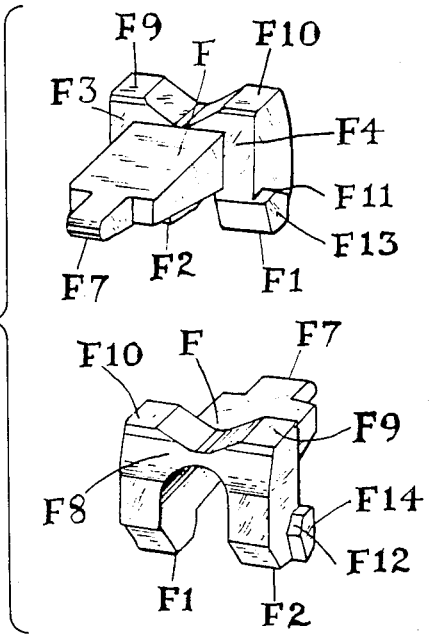
FIG. 11 is two perspective views of the locking block, the upper view from left front upper, the lower view from rear right upper.

When the slide is held in the rear position by the slide hold open catch as in FIGS. 7 and 8, the front lower corner G3 of the hold open catch clears away from the ledge E13 of the rotary lock catch. When pressure is exerted against end E14 of the rotary lock catch, the catch will move axially and the catch arm will clear out of the frame recess A5 and the catch arm can then be rotated clockwise when viewed from the left of the pistol. Upon the catch being moved axially from the right side of the pistol towards the left, the stud E15 on the inward side of end E14 of the rotary lock catch will intrude over the locking block lug F14, and upon rotating the lock catch the stud E15 will force down lug F14 and thus the whole end of the locking block. This will result in the locking block being depressed as shown in FIG. 9, and the barrel lug C8 is clear to travel forward over the rear of the locking block, and thus the barrel can be removed from the slide and from the pistol. When a barrel is replaced in the pistol the rotation anticlockwise of the catch E will force the rear of the locking block up and retain the barrel, and the catch E will be moved axially back to its normal position as in FIG. 1 by the action of a torsion spring K mounted upon frame pin AA having one limb K1 acting against the inner surface E16 of the rotary lock catch, the catch E thus being biased axially towards the right side of the pistol to retract the catch arm E1 into the frame recess A5, and the stud E2 into frame bore A6. A clip P is mounted upon the rear of the recoil spring guide; the upper forward part of the clip Pl obstructs any tendency of the locking block to move to the rear when the locking block is forced down by the rotation of the rotary lock catch. The rotary lock catch can be withdrawn from the pistol frame when the torsion spring K is removed from the pistol.

The application of the invention to other small arms differs in no essential respect from this application to pistols of the type hereinbefore described.

The terms front and rear, horizontal and vertical as used herein refer to the pistol or other firearm when held in the normal firing position.

I claim:

1. A self loading firearm of the locked breech, short recoil pistol type having a frame, a barrel having an underside, a breech block slide and hold open means operative to hold the slide in a fully retracted position relative to the frame, said firearm being provided with a locking block accommodated in part beneath the underside of the said barrel, said locking block being provided with means for positively locking the barrel to the slide during the high pressure period of the firing cycle of the firearm and means for enabling release of the slide from the barrel during the remainder of the firing cycle, means being provided for permitting release of the locking block only when the breech block slide is held to the fully retracted position by said hold open means to disengage the barrel to permit the barrel to be removed from the firearm without need for further disassembly of the firearm without need for further disassembly of the firearm, said means for permitting release of the locking block comprising a rotary catch which is rotatable between a position to hold the locking block in its barrel retaining position and a position in which the locking block is able to release the barrel, said catch being axially moveable between a position in which it is non-rotatable to a position in which it is rotatable to its position in which it permits the locking block to release the barrel.

2. A firearm according to claim 1, wherein the hold open means is operable to hold the rotary catch against axial movement except when the hold open means is operative to hold the slide in its fully retracted position.

3. A firearm according to claim 1, wherein an axially parallel recoil spring is mounted below the barrel.

4. A self loading firearm of the locked breech, short recoil pistol type having a frame, a barrel having an underside and a breech block slide movable relative to said frame between a forward battery position and a rearward fully retracted position, said firearm also comprising a locking block located at least in part beneath the underside of said barrel and movable between a raised barrel retaining position and a lowered barrel release position, a rotary catch having an upper surface, said rotary catch being axially movable between a retracted and a projecting position and being, when in said projecting position, rotatable between a position in which said upper surface holds the locking block in its barrel retaining position and a position in which said upper surface permits the locking block to be lowered to release the barrel, and slide hold open means operative to hold the slide in said fully retracted position relative to the frame, said slide open means holding the rotary catch against axial movement from said retracted position except when the slide hold open means is fully operative, it being necessary axially to move the rotary catch between said retracted position in which it is non rotatable to said projecting position in which it is rotatable to permit the locking block to release the barrel.

5. A firearm according to claim 4, including cam means on the frame operative to cam the locking block downwardly from engagement with the slide during initial rearward movement of the slide from said forward battery position.

6. A firearm according to claim 5, wherein the locking block is forwardly movable relative to the frame during final movement of the slide to the forward battery position and the frame comprises a cam surface engageable with the locking block to cam it upwardly to engage the slide during final movement of the slide to the forward battery position.

7. A self loading firearm of the locked breech, short recoil pistol type having a frame, a barrel having an underside and a breech block slide movable relative to said frame between a forward battery position and a rearward fully retracted position, said firearm also comprising a locking block located at least in part beneath the underside of said barrel and movable between a raised barrel retaining position and lowered barrel release position, a rotary catch having an upper surface, said rotary catch being axially movable between a retracted and a projecting position and being, when in said projecting position, rotatable between a position in which said upper surface holds the locking block in its barrel retaining position and a position in which said upper surface permits the locking block to be lowered to release the barrel, and a helical coil compression recoil spring mounted below and axially parallel with the barrel and partially encompassed by said rotary catch and said locking block.

8. A firearm according to claim 7, wherein the barrel has a recessed lug provided thereon and said locking block comprises a forward radiused nose received in the recess in the lug on the barrel, the locking block having at its rear end two downwardly extending lugs for engagement with the upper surface of the rotary catch, said lugs extending downwardly on opposite sides of the recoil spring.

* * * * *